US010012386B2

(12) United States Patent
Prade

(10) Patent No.: US 10,012,386 B2
(45) Date of Patent: Jul. 3, 2018

(54) LOCAL IMPROVEMENT OF THE MIXTURE OF AIR AND FUEL IN BURNERS COMPRISING SWIRL GENERATORS HAVING BLADE ENDS THAT ARE CROSSED IN THE OUTER REGION

(71) Applicant: SIEMENS AKTIENGESELLSCHAFT, München (DE)

(72) Inventor: Bernd Prade, Mülheim (DE)

(73) Assignee: SIEMENS AKTIENGESELLSCHAFT (DE)

( * ) Notice: Subject to any disclaimer, the term of this patent is extended or adjusted under 35 U.S.C. 154(b) by 380 days.

(21) Appl. No.: 14/420,204

(22) PCT Filed: Jun. 13, 2013

(86) PCT No.: PCT/EP2013/062248
§ 371 (c)(1),
(2) Date: Feb. 6, 2015

(87) PCT Pub. No.: WO2014/023462
PCT Pub. Date: Feb. 13, 2014

(65) Prior Publication Data

US 2015/0285499 A1 Oct. 8, 2015

(30) Foreign Application Priority Data

Aug. 6, 2012 (DE) ..... 10 2012 213 853

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01); *F23C 2900/07001* (2013.01)

(58) Field of Classification Search
CPC .... F23R 3/12; F23R 3/14; F23R 3/286; F23C 7/004; F23C 7/006; F23C 2900/07001; F05D 2240/122; F05D 2260/961
(Continued)

(56) References Cited

U.S. PATENT DOCUMENTS 2,798,661 A * 7/1957 Willenbrock, Jr. ..... F02C 7/04 114/20.2
4,830,315 A * 5/1989 Presz, Jr. ..... B64C 21/10 114/102.29
(Continued)

FOREIGN PATENT DOCUMENTS

CN 1678871 A 10/2005
CN 1707163 A 12/2005
(Continued)

OTHER PUBLICATIONS

International Preliminary Report on Patentability dated Oct. 16 2014 issued in corresponding International patent application No. PCT/EP2013/062248.
(Continued)

*Primary Examiner* — William H Rodriguez
*Assistant Examiner* — Jason H Duger
(74) *Attorney, Agent, or Firm* — Ostrolenk Faber LLP

(57) ABSTRACT

A burner having an air supply and a premix channel having an essentially annular cross-section, through which air and fuel flow during operation, and which is formed of an outer shell (5) and a hub (6). A plurality of swirl blades (7) arranged in the burner extend from the hub (6) to the outer shell (7) in a radial direction. Each blade's surface (11) is provided with a deflection in a radial outer region of the swirl blade (7), a downstream flow angle (α) to a main flow
(Continued)

direction (13) increases at least once and decreases at least once in a radial direction at an outflow end (12) of the deflection surface (11).

5 Claims, 3 Drawing Sheets

(58) Field of Classification Search
USPC ..... 60/735
See application file for complete search history.

(56) References Cited

U.S. PATENT DOCUMENTS

| | | | | |
|---|---|---|---|---|
| 5,197,290 | A * | 3/1993 | Lee | F23R 3/14 137/855 |
| 5,647,200 | A * | 7/1997 | Althaus | F02K 3/10 60/39.17 |
| 6,141,967 | A * | 11/2000 | Angel | F23R 3/286 239/405 |
| 6,331,100 | B1 | 12/2001 | Liu et al. | 416/238 |
| 6,993,916 | B2 | 2/2006 | Johnson | 60/776 |
| 7,632,091 | B2 * | 12/2009 | Steinbach | F23C 7/002 431/350 |
| 7,753,677 | B2 | 7/2010 | Berenbrink | 431/183 |
| 7,878,001 | B2 * | 2/2011 | Ishizaka | F23R 3/286 431/182 |
| 8,528,313 | B2 * | 9/2013 | Carroni | F23D 14/64 60/39.17 |
| 8,677,756 | B2 * | 3/2014 | Poyyapakkam | F23C 5/08 239/403 |
| 8,820,047 | B2 | 9/2014 | Saito | |
| 8,925,323 | B2 * | 1/2015 | Zuo | F23R 3/14 60/737 |
| 9,347,663 | B2 * | 5/2016 | Poyyapakkam | F23C 7/004 |
| 9,400,105 | B2 * | 7/2016 | Genin | F23R 3/286 |
| 2006/0035188 | A1 | 2/2006 | Berenbrink et al. | |
| 2008/0148736 | A1 | 6/2008 | Ishizaka et al. | |
| 2009/0277178 | A1 | 11/2009 | Carroni et al. | |
| 2010/0205971 | A1 | 8/2010 | Williams et al. | 60/748 |
| 2010/0276007 | A1 | 11/2010 | Hendrick | 137/15.1 |
| 2010/0326079 | A1 * | 12/2010 | Zuo | F23R 3/286 60/748 |
| 2012/0006029 | A1 * | 1/2012 | Bilbao | F23R 3/14 60/737 |

FOREIGN PATENT DOCUMENTS

| | | | | |
|---|---|---|---|---|
| CN | 101878395 | A | 11/2010 | |
| DE | 44 06 399 | A1 | 10/1994 | |
| DE | 10 2009 038 845 | A1 | 3/2011 | |
| DE | 11 2006 000 427 | B4 | 3/2011 | |
| EP | 1 394 471 | A1 | 3/2004 | |
| EP | 2 116 768 | A1 | 11/2009 | |
| JP | H 07332621 | | 12/1995 | |
| RU | 2 228 461 | | 5/2004 | |
| RU | 105 005 | | 5/2011 | |
| WO | WO 2011/023669 | A1 | 3/2011 | |
| WO | WO 2011054766 | A2 * | 5/2011 | F23R 3/12 |

OTHER PUBLICATIONS

International Search Report dated Jan. 14, 2014 issued in corresponding International patent application No. PCT/EP2013/062248.
German Search Report dated Apr. 22, 2013 issued in corresponding German patent application No. 10 2012 213 853.6.
Chinese Office Action, dated Aug. 3, 2015, issued in corresponding Chinese Patent Application No. 201380037149.0. Total 6 pages.

* cited by examiner

LOCAL IMPROVEMENT OF THE MIXTURE OF AIR AND FUEL IN BURNERS COMPRISING SWIRL GENERATORS HAVING BLADE ENDS THAT ARE CROSSED IN THE OUTER REGION

CROSS-REFERENCE TO RELATED APPLICATIONS

The present application is a 35 U.S.C. §§ 371 national phase conversion of PCT/EP2013/062248, filed Jun. 13, 2013, which claims priority of German Patent Application No. 10 2012 213 853.6, filed Aug. 6, 2012, the contents of which are incorporated by reference herein. The PCT International Application was published in the German language.

TECHNICAL FIELD

The invention relates to a burner with fuel-admixing swirl generators and in particular to the local improvement of the mixing of air and fuel.

TECHNICAL BACKGROUND

Evenly admixing fuel into the combustion air is the central design concern in the development of burners which are operated in the range of what is termed lean premix combustion. The temperature range for lean premix combustion is particularly suitable for gas turbines because of the material-imposed restriction on the combustion chamber outlet temperature for the purpose of controlling nitrous oxide emissions. The difficulty with premix combustion, in particular under pressure, is the avoidance of uncontrollable combustion events/auto-ignition within the premix path, which are generally associated with destruction of the premix path.

As a rule of thumb, it can be assumed that a premix which is as homogeneous as possible also results in minimal $NO_x$ emissions.

In general, technical burners are of approximately rotationally symmetric construction and often have one or more swirl generators arranged concentrically around each other. The current prior art is to embody the swirl generator blades as hollow blades and simultaneously to use them as fuel injection elements, see for example WO 2011/023669. Such arrangements generally mean that there is a marked difference in the spacing between two adjacent blades at the hub compared to the outer section, i.e. the blades are generally much closer together at the hub than in their outer region. This gives rise to the problem of injecting the fuel sufficiently far, in particular in the radially outer region, into the interspace between two blades, in order to achieve the best possible mixing, while this is substantially easier to achieve at the hub side.

There have been suggestions for how to solve this problem. In general, however, the improvement is not enormous.

For example:

Increasing the fuel bore diameter from the inner regions to the outer regions. This does result in a partial—although not entirely sufficient—improvement in the penetration depth of the fuel jets, although at the same time the required mixing path is increased (approximately proportional to the diameter of the fuel bore).

Increasing the number of blades. This faces structural and aerodynamic limitations due to the available space on the hub and the increasing blocking of the air flow on the hub side.

Using strongly 3-dimensional blade profiles whose blade thickness increases with increasing distance from the hub. Here, too, problems arise with respect to the aerodynamic contour of the blade, this time in the outer section, in order to go from the large blade thickness in the plane of the fuel bores back to a very thin blade end, i.e. the outer portion of the blades would then be very long.

SUMMARY OF THE INVENTION

The invention has the object of providing a burner of the type mentioned in the introduction, which permits better mixing of air and fuel, in particular in radially outer regions of the premix path.

The invention achieves this object in that it provides that, in the case of such a burner with an air supply and premix duct which is of substantially annular cross section, through which, in operation, air and fuel flow, which is formed by an outer shell and a hub and in which multiple swirl blades are arranged which extend radially from the hub to the outer shell and have deflection surface, and in a radial outer region of the swirl blades, a flow-off angle with respect to a main flow direction at a flow-off end of the deflection surface which increases at least once and decreases at least once in the radial direction.

The invention proceeds from the recognition that the locally present turbulence intensity represents an additional influencing parameter on the admixing of the fuel into the air. Increasing the turbulence intensity has the effect of promoting mixing.

It is therefore proposed, in particular in the outer section, to increase the turbulence intensity or to generate mixing-promoting vortices.

In one advantageous embodiment, at a radially inner flow-off end of the deflection surface, a flow-off angle $\alpha_1$ has an angular measure between a flow-off angle $\alpha_3$ of a radially outer flow-off end and a flow-off angle $\alpha_2$ of a flow-off end therebetween. In the shear zones of the regions with different flow-off angles, the turbulence is then locally increased, because of the shearing, in the form of a vortex.

In that context, it can be expedient if the flow-off angles $\alpha$ of adjacent swirl blades exhibit different radial profiles.

The swirl blades are preferably at least partially embodied as hollow blades with outlet openings for fuel.

It is expedient if the air supply and premix duct concentrically surrounds a central pilot burner system.

The local use of mixing-promoting turbulence by means of mutually "crossed" blade ends improves the mixing quality in the outer section, without strongly influencing the inner regions. Furthermore, the mixing quality is made more independent of the operating conditions.

The invention will be described by way of example with reference to the drawings, which are not to scale and in which:

Figure 1:
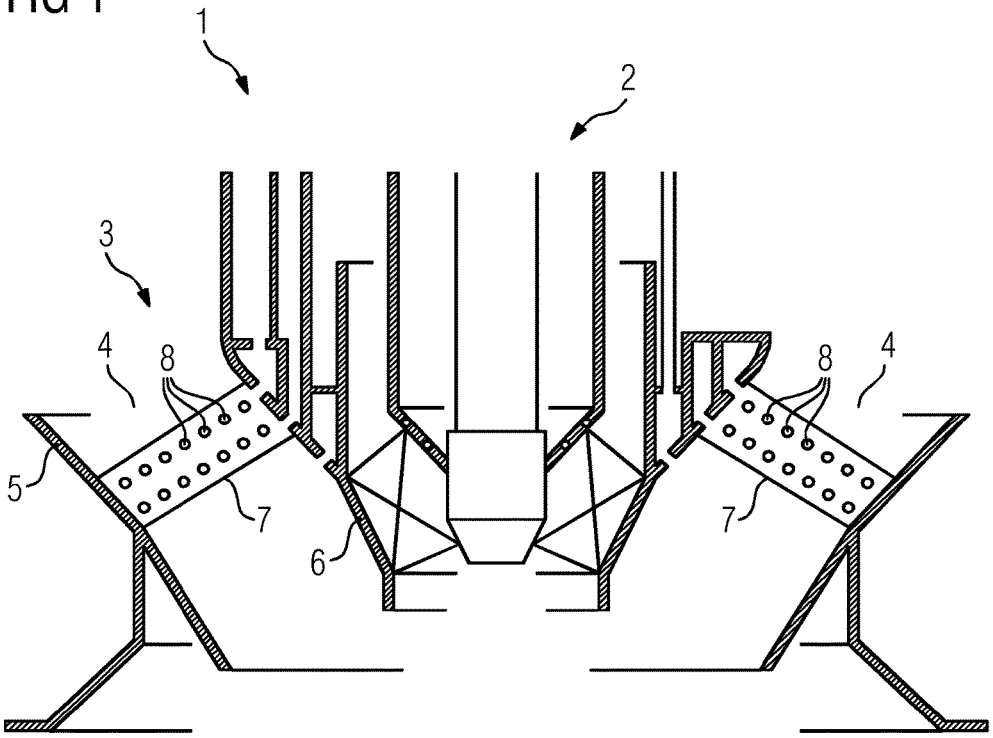
FIG. 1 shows a burner in a highly schematized basic diagram.

The burner 1 shown in FIG. 1, which may be used in connection with multiple similar burners for example in the combustion chamber of a gas turbine installation, comprises an inner pilot burner system 2 and a main burner system 3 which concentrically surrounds the pilot burner system 2. Both the pilot burner system 2 and the main burner system 3 can optionally be operated with gaseous and/or liquid fuels such as natural gas or heating oil.

The main burner system 3 comprises a radially outer air supply and premix duct 4, also called an annular air duct, which is formed by an outer shell 5 and a hub 6 and through which there extend a plurality of swirl blades 7 of a swirl blading. These swirl blades 7 have outlet openings 8 for fuel, through which combustion gas can be injected into the air flowing in through the radial air supply and premix duct 4.

Figure 2:
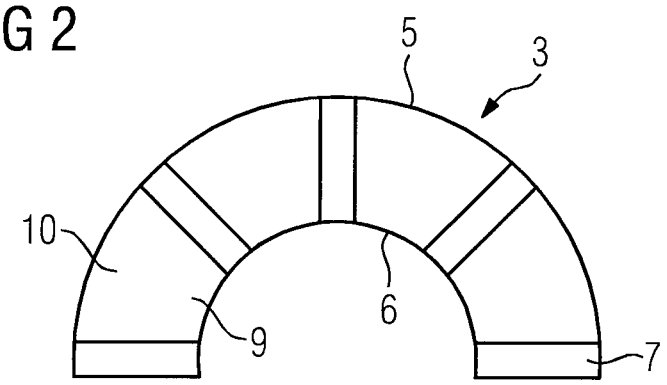
FIG. 2 is a plan view of an unwound part of the main burner system.

FIG. 2 shows an unwound part of the main burner system 3 in plan view with a plurality of the swirl blades 7 and highlights the regions of good 9 and bad 10 admixing of the fuel in air. Radially inwards, that is to say in the vicinity of the hub 6, the blades 7 are comparatively close together, such that the fuel can be injected sufficiently far into the interspace between two blades 7 in order to achieve the best possible mixing. Radially outwards, in the vicinity of the outer shell 5, the blades 7 are accordingly further apart from each other, making it more difficult to inject the fuel sufficiently far into the air.

Figure 3:
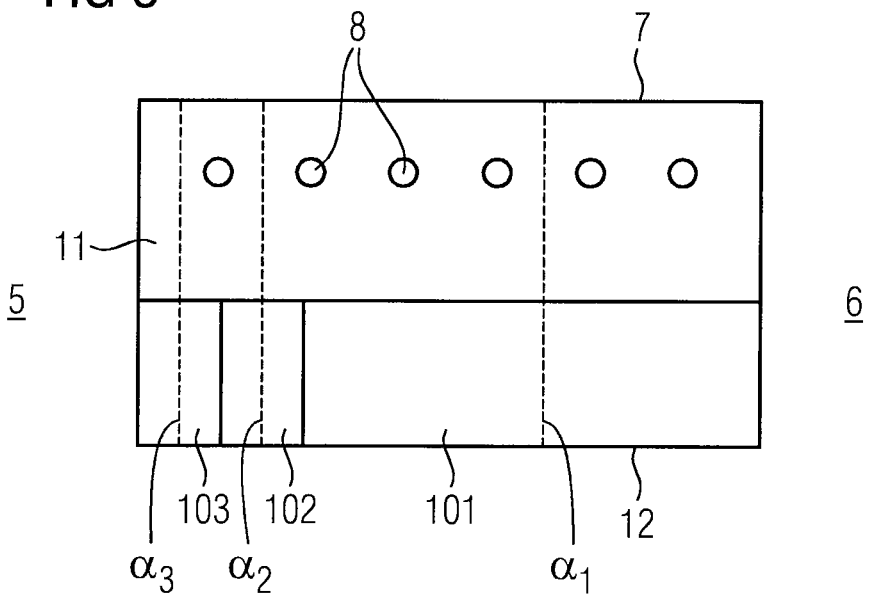
FIG. 3 is a plan view of a swirl blade.

FIG. 3 shows the view of the deflection surface 11 of a swirl blade 7 of a burner 1 according to the invention. The swirl blade 7 extends in the burner 1 from the radially inward hub 6 (to the right) to the radially outward outer shell 5 (to the left). Furthermore, in the exemplary embodiment of FIG. 3, the swirl blade 7 is embodied as a hollow blade with outlet openings 8 for fuel. For the purpose of improved understanding of the invention, three regions 101, 102 and 103 shown in respective radial direction lengths by the solid lines are labeled in the region of the flow-off end 12 of the deflection surface 11, wherein the regions 102 and 103 are to be attributed to the radially outer region of the blade 7.

Figure 4:
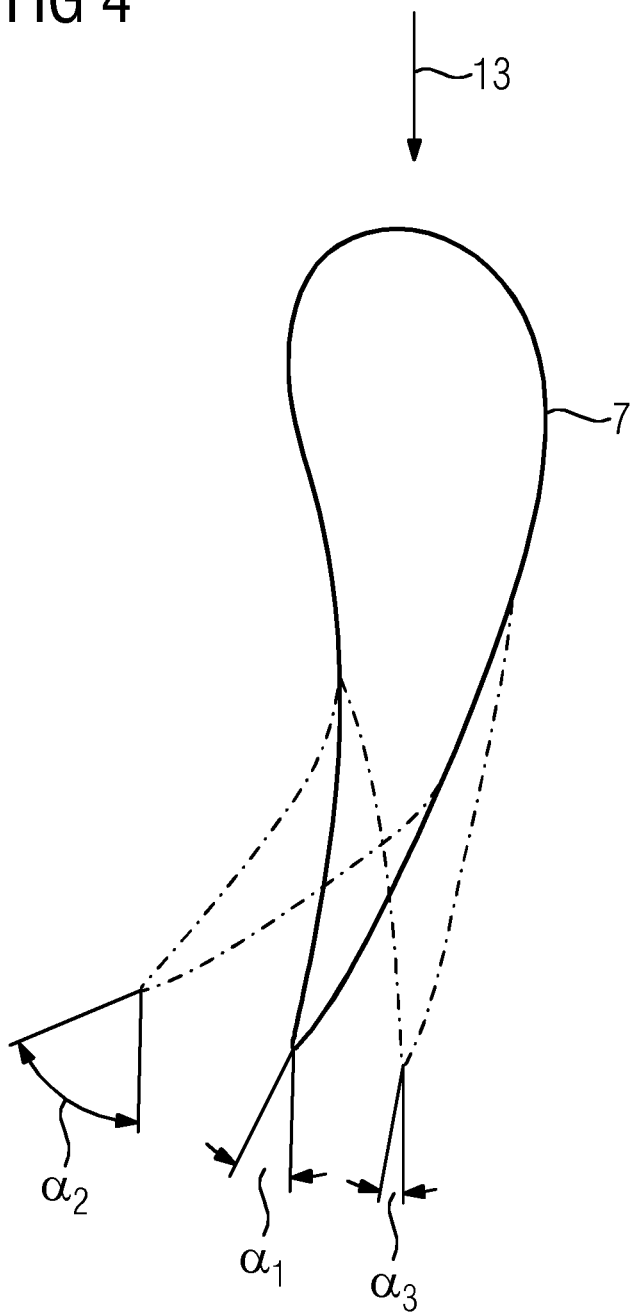
FIG. 4 shows sections through a swirl blade, showing their respective offsets in the radial direction from the hub to the outer shell.

FIG. 4 shows the three sections, laid in the radial direction one after one the other, through the regions 101, 102 and 103 of the swirl blade 7 of FIG. 3, as seen from the hub 6 towards the outer shell 5. It can be seen that, at a radially inward flow-off end 12 of the deflection surface 11, i.e. in the section through the region 101, the flow-off angle $\alpha_1$ with respect to a main flow direction 13 is between a flow-off angle $\alpha_3$ of a radially outer flow-off end 12, i.e. in the section through the region 103, and a flow-off angle $\alpha_2$ of a flow-off end therebetween, i.e. in the section through the region 102.

Other embodiments of the swirl blade 7, in which in a radially outer region a flow-off angle $\alpha$ with respect to a main flow direction 13 at a flow-off end 12 of the deflection surface 11 increases at least once and decreases at least once in the radial direction, are also possible as long as, in the outer region of the swirl blade 7, i.e. in the vicinity of the outer shell 5, a sort of crossover is achieved at the blade end, such that there, in the shear zone arising in operation, a mixing vortex is generated.

The invention claimed is:

1. A burner configured to inject fuel and air into a combustion chamber of a gas turbine, the burner comprising:

a duct of substantially annular cross section formed by and between a radially outer annular shell and a radially inner annular hub, through which the air and the fuel flow and mix;

multiple swirl blades arranged in the duct, each one of the multiple swirl blades including openings for supplying the fuel into the duct and extending a total radial length from the radially inner annular hub to the radially outer annular shell;

each one of the multiple swirl blades having a deflection surface comprising an aft portion, the aft portion of each one of the multiple swirl blades having a first region having a first radial length extending from the radially inner annular hub to a radially inner boundary of a second region, the second region having a second radial length, and a third region having a third radial length extending from a radially outer boundary of the second region to the radially outer annular shell, wherein together the first radial length, the second radial length, and the third radial length extend the total radial length from the radially inner annular hub to the radially outer annular shell, each of the first region, the second region, and the third region having a respective flow-off angle along the first radial length, the second radial length and the third radial length, each respective flow-off angle being defined with respect to a main flow direction at a flow-off end of the aft portion of the deflection surface;

wherein the respective flow-off angle of the first region along the first radial length is greater than the respective flow-off angle of the third region along the third radial length and less than the respective flow-off angle of the second region along the second radial length.

2. The burner as claimed in claim 1, wherein adjacent ones of the multiple swirl blades have different radial profiles with non-equal respective flow-off angles in at least one of: the first region, the second region, and the third region.

3. The burner as claimed claim 1, wherein each one of the multiple swirl blades are at least partially hollow.

4. The burner as claimed in claim 1, further comprising a central pilot burner system concentrically surrounded by the duct.

5. The burner as claimed in claim 3, wherein adjacent ones of the multiple swirl blades have different radial profiles with non-equal respective flow-off angles in at least one of: the first region, the second region, and the third region.

* * * * *